United States Patent [19]

Deutsch et al.

[11] 4,295,402

[45] Oct. 20, 1981

[54] AUTOMATIC CHORD ACCOMPANIMENT FOR A GUITAR

[75] Inventors: Ralph Deutsch; Leslie J. Deutsch, both of Sherman Oaks, Calif.

[73] Assignee: Kawai Musical Instrument Mfg. Co., Ltd., Hamamatsu, Japan

[21] Appl. No.: 88,978

[22] Filed: Oct. 29, 1979

[51] Int. Cl.[3] ..... G10F 1/00

[52] U.S. Cl. ..... 84/1.03; 84/1.16; 84/1.24; 84/DIG. 30; 84/DIG. 22

[58] Field of Search ..... 84/1.03, 1.16, DIG. 22, 84/DIG. 30, 1.24

[56] References Cited

U.S. PATENT DOCUMENTS

| | | | |
|---|---|---|---|
| 2,792,738 | 5/1957 | Donahue | 84/267 |
| 3,662,641 | 5/1972 | Allen et al. | 84/1.16 |
| 3,786,167 | 1/1974 | Borell et al. | 84/1.16 |
| 3,871,247 | 3/1975 | Bonham | 84/1.16 |
| 3,967,520 | 7/1976 | Drydyk | 84/DIG. 2 |
| 4,142,433 | 3/1979 | Gross | 84/DIG. 22 |
| 4,144,788 | 3/1979 | Bione et al. | 84/1.01 |

*Primary Examiner*—J. V. Truhe
*Assistant Examiner*—Forester W. Isen
*Attorney, Agent, or Firm*—Ralph Deutsch

[57] ABSTRACT

In an electrical tone generator apparatus is provided for automatically selecting one of a library of chord types which is closest to a chord fingered on a fretted string instrument. The closest decision is made by processing the fingered fret input data by a set of matched filters each of which corresponds to a member of the library of chord types. The chord type decision is made to correspond to the matched filter producing the maximum output response. The selection between chord types yielding equal responses is resolved by priority logic based upon the frequency of chord usage. A root note is chosen for each chord type. Note keying data is generated from the selected chord types which is transposed to the correct musical pitches in response to the chosen root note. The note keying data is grated by an automatic rhythm generator and the output is used to actuate electronic musical tone generators.

22 Claims, 8 Drawing Figures

AUTOMATIC CHORD ACCOMPANIMENT FOR A GUITAR

BACKGROUND OF THE INVENTION

1. Field of the Invention

This invention relates broadly in the field of electronic musical tone generators and in particular is concerned with the provision for chord accompaniment for a guitar employing automatic detection of the chord type and root note fingered on the guitar.

2. Description of the Prior Art

Musical chords can be defined as a combination of notes which sound "pleasant" when played simultaneously. Experimentally musicians have found that chords are a set of notes with prescribed semi-tone intervals based upon a given tone which is called the root tone, root note, or simply the root. If the root note is the lowest note of a chord the chord is said to be in the fundamental position, or normal order, or not inverted. If any note other than the root note is the lowest note then the chord is said to be inverted or is in the inverted order. It is common practice to use inverted chords so that all the notes of a given chord are limited to a single octave of a keyboard musical instrument. For the same reason, inverted chords are commonly used when fingering fretted musical instruments such as the guitar.

The guitar is basically a solo instrument but because of its use of a suboctave string it can provide its own low frequency rhythmic accompaniment. Thus in the hands of a skilled player a musical effect can be produced which is the combination of melodic chords and rhythmic background.

There is a growing tendency on the part of guitar players to extend the tonal effects of their instruments by resorting to the use of a variety of electronic tone devices that are coupled to the instrument. These include devices such as phasers, flangers, and echo systems. Automatic rhythm units are frequently used as an independent adjunct to substitute for an accompaniment percussion player and thereby provide the effect of a small musical group.

In an effort to extend the musician's total tonal effects, some guitar players employ a pedal board which is constructed in a fashion similar to that used with small organs. These pedal boards contain key switches that actuate an electronic musical tone generator that is usually voiced and pitched to provide a bass line accompaniment for the guitar player. The combination musical effect obtained by the simultaneous use of a guitar and pedal board accompaniment is well liked. The principal defect with such a system combination lies in the requisite skill required to effectively operate a pedal board while playing a guitar. Even organ players require a great deal of practice before they acquire the dexterity required to use their feet to produce artful pedal rhythmic accompaniments to the notes played on the organ's manual keyboards.

Chord organs have been implemented in which the player selects the chord type and root note from a set of buttons similar to the manner used for the bass accompaniment in accordians.

In U.S. Pat. No. 2,645,968 Hanert discloses means to play a chord selected from a set of buttons. The selected chord root note and its musical fifth can be applied to a pedal generator by actuating one of two pedals. Such an arrangement is not entirely suitable for the guitarist because he cannot easily actuate a button from a set of buttons while simultaneously fingering the strings of a guitar.

Many of the current keyboard musical instruments of the organ family have provisions for semi-automatic modes for playing accompaniment in rhythmic patterns determined by logic states obtained from an automatic rhythm device. Moreover the pedal notes are alternated between notes in a rhythmic pattern while the selection of these notes is transferred in a predetermined fashion from notes actuated on the lower keyboard (usually played as a left hand accompaniment). The alternated notes are controlled automatically by a rhythm generator system. In such systems wherein the pedal note is determined from actuated accompaniment chords played on the lower keyboard, a detection subsystem is required to determine the proper root note for the actuated chords.

Various detection systems have been proposed and constructed for finding the root note corresponding to a group of notes played on a particular keyboard. Many of these detection systems are very limited in capability in that the musician must preselect the type of chord types to be used such as major and minor triads. In addition to the "normal" functions, some sort of default logic must be provided to take care of the almost nonsensical situations in which incorrect or disonant note combinations are played on the lower keyboard, or any other keyboard which is used to provide chord input data as a set of actuated key switches.

In U.S. Pat. No. 4,019,417 there is described a means for generating chords from notes actuated on a keyboard. A chord memory is provided which stores data for a preselected list of chord types. Logic is provided for chord detection based upon the preselection of one or three note chord operation by the musician. The chord detection logic determines whether the selected chord (one or three notes) is a minor or major chord. In addition, a root note is selected corresponding to the chord detection decision. A priority logic is incorporated which selects the root note of the lowest detected chord if more than one chord has been detected. A provision is also included for the situation in which inverted chords are played on the input keyboard.

Examples of prior art systems in which selected chords are played rhythmically are described in U.S. Pat. Nos. 3,711,618, 3,715,442 and 4,019,417. The prior art systems are primarily intended for beginning organ players and are often limited in that the root note and chord type identification must be given to the system. If the number of chord types is limited, then some simple root note and chord type selection has been accomplished such as in the system disclosed in U.S. Pat. No. 4,019,417. However, no provisions have been made for advanced musicians who can correctly play a wide variety of chord types or for the player skills in transition between the beginner and expert.

The present invention provides a novel means for automatically producing an alternating bass and rhythmic chord accompaniment for a guitar player using a guitar and an electronic tone generation system. The invention includes means for detecting fingered chord types and their corresponding root notes for a wide variety of chord types and incorporates features which permit operation when either accidental mistakes or completely nonsensical combinations of notes are fingered on the guitar.

SUMMARY OF THE INVENTION

The present invention is directed to a novel and improved arrangement for automatically producing an alternating bass and rhythmic chord accompaniment for the guitar player using tones produced by an electronic tone generating apparatus. An essential feature is an arrangement for detecting the chord type fingered on the guitar and for determining the proper root note for the detected chord type.

While the guitar is not a keyboard musical instrument in the form of an organ or piano, it is a generic form of a keyboard instrument in that it uses a system of frets. The frets act to limit the effective lengths of the strings to almost exact intervals corresponding to notes on the equal tempered musical scale. The musician selects a note by placing a finger tightly on a string. The finger pressure terminates the free vibrating length of the string at the first fret lower (shorter) than the position of the finger. Means are provided for detecting the combination of frets that have been fingered. From this information a chord type is selected which is "closest" in a matched filter sense of maximum correlation with a set of stored reference chord information. At the same time that the chord selection is made the chord's root note is determined. Using the closest selected chord type and its corresponding root note, an electronic musical tone generator and an associated automatic rhythm generator are used to provide rhythmic musical accompaniment which is self adaptive to the succession of chords fingered by the guitar player.

The chord detection means employs a multiplicity of matched filters. It is known in the signal theory art that a matched filter will provide as an output signal for a noisy input signal one that has a maximum signal to noise power ratio. Moreover, it is known that the matched filter's impulse response must be the reversed image of the known signal. A discussion of these properties can be found starting on page 163 of the book:

Ralph Deutsch, *System Analysis Techniques.* Englewood Cliffs, N.J., Prentice-Hall, Inc., 1969.

The position of the fingered frets on the guitar is translated to a binary serial pulse data stream. The serial data is passed through a set of seven matched filters. Using threshold logic, the chord type from a preselected set of chord types is chosen which is closest in a mean-square signal sense to the fingered frets. At the same time the root note of the chosen chord type is determined. Using seven matched filters is sufficient to detect almost every commonly used chord types in guitar playing.

It is an objective of the present invention to provide means for making an optimum or best decision of the fingered chord type and root note even if incorrect or completely nonsensical sets of frets have been fingered.

Another objective of the present invention is to provide chord and root note data from the fingered frets of a guitar without imposing the requirement of preselecting chord types or preselecting the number of fingered strings.

Another objective of the present invention is to provide rhythmic tonal accompaniments in response to the fingered frets of a guitar.

BRIEF DESCRIPTION OF THE DRAWINGS

For a better understanding of the invention reference should be made to the accompanying drawings.

DETAILED DESCRIPTION OF THE INVENTION

Figure 1:
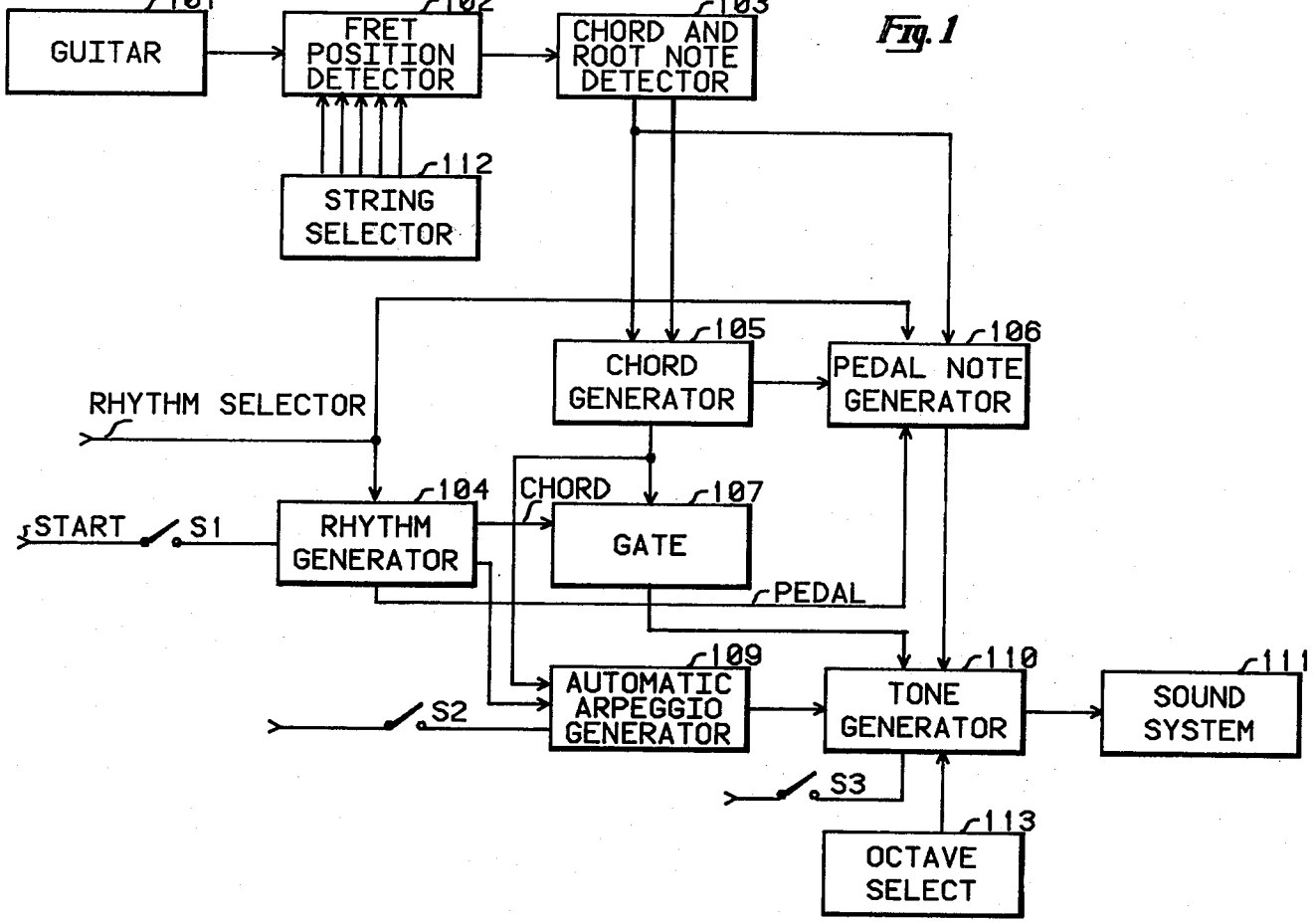
FIG. 1 is a schematic block diagram of an embodiment of the present invention.

FIG. 1 shows an embodiment of the present invention for detecting chords and their root note as fingered on a guitar and for producing automatic rhythmic accompaniment in response to the detected chords.

The fingered fret positions are detected by the fret position detector 102. String selector 112 is preset by the guitar player so that any combination of the guitar strings can be selectively chosen to furnish fret position information to the fret position detector 102. Thus only a single string can be used for the input data if solo melody lines are played or alternatively more string fret positions can be used when chord information is used for the input data.

Chord and root note detector 103 operates to select the closest chord type to the input data and to furnish the corresponding root note.

Chord generator 105 contains circuitry wherein the chord type and root note data furnished by chord and root note detector 103 is transformed to signals that will cause the tone generator 110 to create musical tones corresponding to the chord type and root note data.

Rhythm generator 104 is an automatic rhythm device which furnishes logic signals to gate 107. Gate 107 in response to signals from the rhythm generator 104, interrupts the chord generator 105 output signals thereby causing the tone generator 110 to produce the desired rhythmic musical chords which provide the accompaniment to the guitar.

Pedal note generator 106 consists of circuitry, whereby the input root note signal and other related notes are furnished simultaneously to select gate 108.

The rhythm generator 104 also furnishes logic signals to the select gate 108 which causes the root note signal or the other note signal to be selectively transferred to the tone generator 110 in a preselected rhythmic pattern.

The tone generator 110 is an electronic musical polyphonic tone generator whose tone generators are keyed in response to the chord data and root note/other note data input signals.

Octave select 113 is used to preselct the musical octave in which the accompaniment rhythmic chords and root/other notes are sounded. The usual practice is to cause the root/other note to sound in octave 1 ($C_1$-$B_1$) which corresponds to the low pedal octave for an organ.

Switch S1 is used to start or stop the rhythm generator 104.

The automatic arpeggio generator 109 uses the chord data signal to generate signals which cause the tone generator 110 to create automatic arpeggios in response to the chord data signals. The arpeggio is controlled by switch S2. The automatic arpeggio generator 109 uses logic signals furnished by the rhythm generator 109 so that the arpeggios can be played in preselected rhythmic patterns.

Sound system 111 is a conventional amplifier speaker combination which is used to convert the electrical signals created by the tone generator 110 into audible musical tones.

Figure 2:
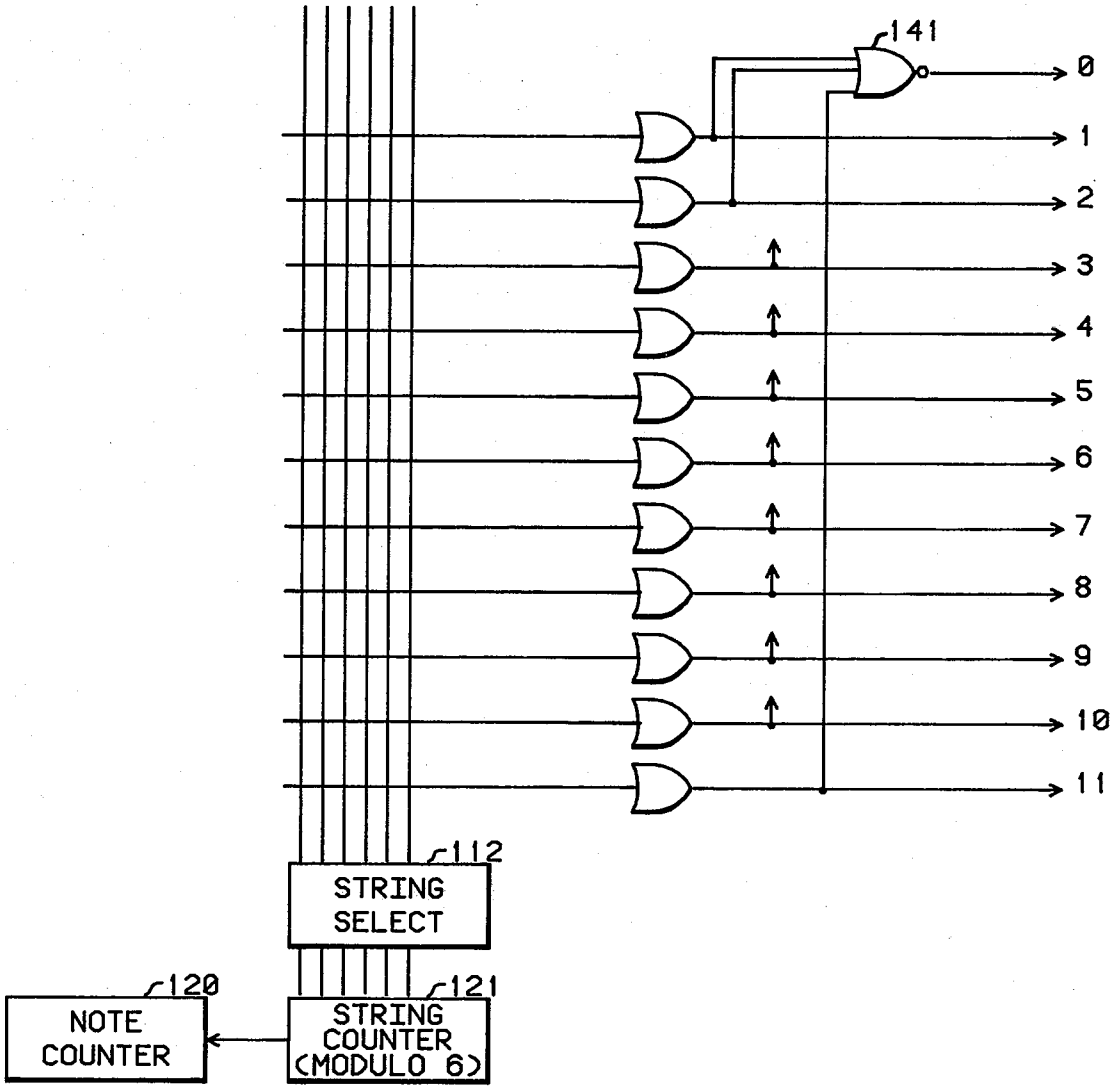
FIG. 2 is a schematic of the fret position signal generator.
Figure 3:
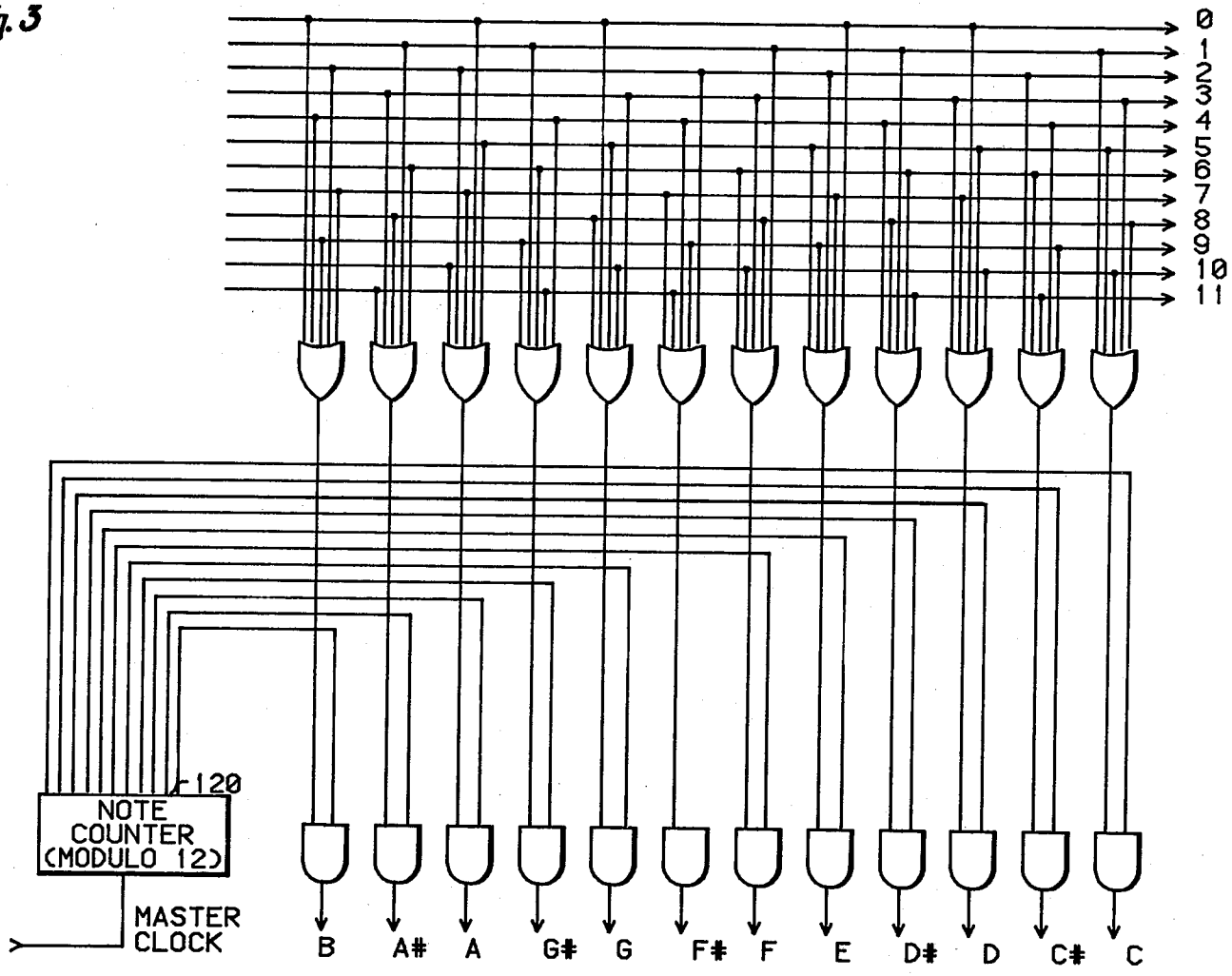
FIG. 3 is a schematic diagram of the fret position conversion to musical notes.

The details of the fret position detector 102 are shown in FIGS. 2 and 3. A guitar normally has 18 frets. Frets which are separated by an interval of 12 frets correspond to octaves of the same note. Advantageously the frets for a guitar used as a data input source should be made from electrically conducting material. The guitar strings should also be metallic and electrically conducting. The individual strings are electrically isolated from each other at the bridge and the mechanical string termination located near the end of the top sounding board surface of the guitar. When a finger is pressed against a string an electrical contact is made between the string and the first fret located between the finger position and the string bridge located on the top surface of the body of the guitar.

Frets that are separated by 12 frets are electrically connected. In this manner all fingered notes are translated into a single octave. For such a connection array, the frets are said to be connected in parallel octaves.

In FIG. 2, the timing signals are generated by the note counter 120. The function of this counter is described below in reference to the logic shown in FIG. 3. The string counter 121 is incremented by the note counter and is implemented to count modulo 6. The guitar is commonly configured with 6 strings. In any case, the string counter 121 is implemented to count modulo the number of guitar strings and advantageously the modulo number can be variable to accomodate an instrument with other than 6 strings. The binary states of the string counter 121 are decoded into six separate lines which are respectively connected to the guitar strings. In this fashion the strings are activated by signals that sequence cyclically in time with the strings. When a string is pressed into contact with a fret by the player's finger, the output signal from the string counter 121 for that particular string and fret is sent to an OR-gate associated with the fret. This is called the fret signal. If no frets are fingered, then the output of NOR-gate 141 will be a logic "1" indicating an "open note" or that the fret signal corresponds to the zero fret.

FIG. 3 shows the details of the logic used to decode the fret electrical signals into signals corresponding to notes of the musical scale. The set of OR-gates serve to connect all similar note signals from the frets onto a single signal line. These signals are called the note number signals. The states of the note counter 120 are used to gate the output signals from the or-gates into the note status register 12, shown in FIG. 4, via the set of AND-gates. The frets are numbered from 0, with 0 being the fret located closest to the tuning pins.

The note counter 120 is implemented to count modulo 12. The binary states of the note counter 120 are decoded into 12 separate lines. Each of the note decoded lines is connected to one of the set of 12 AND-gates. Each time the note counter 120 is reset to its initial state because of its modulo counting mechanization, a reset signal is generated. This reset signal is used to increment the state of the string counter 121. This timing provides for a complete scan of the set of output AND-gates for the musical note signals as each of the guitar strings are activated in turn by the count state of the string counter 121.

Figure 4:
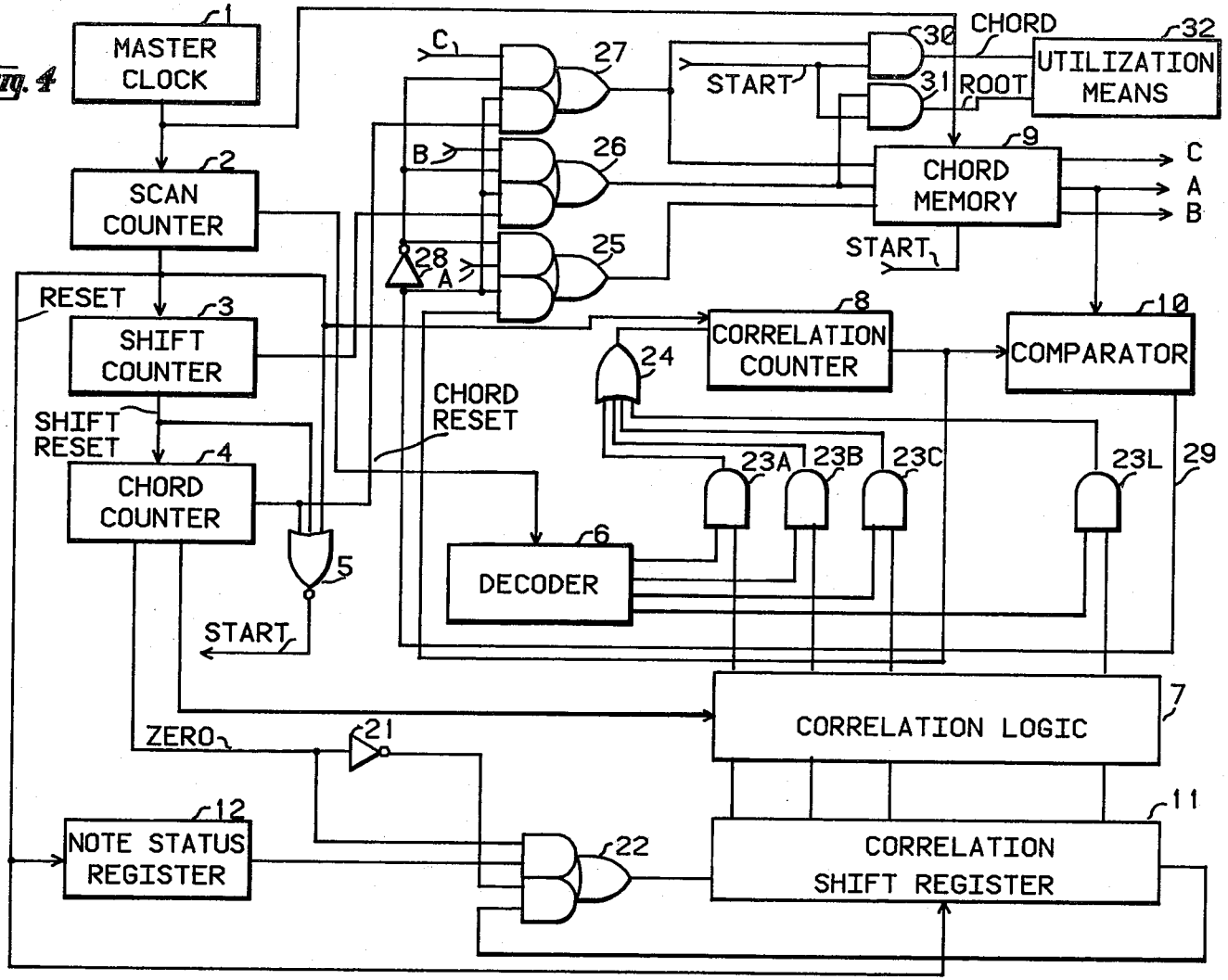
FIG. 4 is a schematic block diagram of the chord type and root note detector.

Note counter 120 is incremented by timing signals generated by the master clock shown in FIG. 4.

The operation of the chord type and root note detector 103 is described in the copending patent application Ser. No. 123,456 entitled Automatic Chord Type and Root Note Detector. This application has the same inventors as the present invention and both are assigned to the same assignee.

The detailed logic of the chord and root note detector 103 is shown in FIG. 4.

The chord data in the form of note signals from the fingered strings and frets are stored in note status register 12. The note status register is advantageously implemented as a parallel loaded 12 bit shift register. Each bit in this shift register corresponds to a specified note in the musical octave. The term "chord" is herein used in a general sense to designate a set of fret signals. Such a "chord" is not limited to be a combination of notes which sound "pleasant."

The timing of the logic functions shown in FIG. 4 is controlled by the master clock 1. The entire chord and root note detection logic requires $7\times12\times12=1008$ master clock timing pulses. For a master clock note of 1 Mhz, the detection logic requires about one milisecond. This time is short enough to be essentially instantaneously for a musical instrument.

Scan counter 2 is a counter which is incremented by the master clock 1 and counts modulo 12. A RESET signal is generated by the scan counter 2 each time it resets itself to its initial state because of its modulo counting implementation. The initial state of a counter is the minimum value of its possible count states.

Shift counter 3 is a counter which is incremented by the RESET signals generated by the scan counter 2. Shift counter 3 counts modulo 12 and generates a SHIFT RESET signal each time the counter resets itself to its initial state because of its modulo counting implementation.

Chord counter 4 is a counter which is incremented by the SHIFT RESET signals generated by the shift counter 4. Chord counter 4 counts modulo 7 and generates a CHORD RESET signal each time the counter resets itself to its initial state because of its modulo counting implementation.

When the count states of the scan counter 2, the shift counter 3, and the chord counter 4 have all been simultaneously incremented to their initial state, the NOR gate 5 will generate a START signal in response to a simultaneous "1" state for the RESET, SHIFT RESET, and CHORD RESET signals. The START signal initializes the process of determining the closest chord type and root note of the actuated key switch status data stored in the note status register 12.

Chord memory 9 is a register whose contents are initialized to zero value in response to the START signal created by the NOR gate 5. Chord memory 9 is divided into three segments. The segment 1 subregister is used to store the highest value of the correlation number obtained in a manner described below. The segment 2 subregister is used to store the chord type number corresponding to the current highest value of the correlation stored in the segment 1 subregister. The segment 3 subregister is used to store the note number of the chord corresponding to the current highest value of the correlation stored in the segment 1 subregister.

The count state of chord counter 4 is used to determine the present type of chord that is being used by the system to examine the current actuated fret status data stored in the note status register 12. Table 1 lists the musical chord types corresponding to each state of the chord counter.

TABLE 1

| Chord counter state | Chord Type |
|---|---|
| 0 | Major |
| 1 | Major |
| 2 | Minor |
| 3 | Dominant 7'th |
| 4 | Diminished |
| 5 | Augmented |
| 6 | Major 7'th |

These chord types are used for illustrative purposes and do not represent a limitation of the present invention. Additional or other chord types can be used in a manner which is evident from the following description. The particular list of chord types shown in Table 1 was selected because these are the chord types most frequently used by the average guitar player.

It is noted that Table 1 lists two chord counter states for a major chord. As explained below this is done to accomodate the situation in which only a single string switch has been actuated. It is convenient to consider a single note as a chord using a generic meaning of the term "chord" to include one or more notes played simultaneously. A single note chord is designated by default to be a major chord. The system can be readily implemented to use another chord type for the default of a one note chord if such a choice is desired.

When the START signal is created by the NOR gate 5, chord counter 4 will be in its initial, or zero count state. In response to the zero state signal from chord counter 4, the select gate 22 will transfer data read serially from note status register 12 to the correlation shift register 11.

Data is addressed out of the note status register 12 in response to the RESET signals created by scan counter 2. This data is transferred to the correlation shift register 11 only during the time interval in which chord counter 4, is in its zero state. For the remainder of the 7 states of the chord counter 4, the data previously loaded into the correlation shift register 11 during the zero state is shifted in the normal end-around operation mode for a shift register. The end-around data circulation is controlled by the Inverter 21 in combination with data select gate 22. The correlation shift register 11 contains 12 bits, each corresponding to a note of the musical scale. An output data point is provided for each bit stored in this device.

The count states of the chord counter 4 are used to select the operating status of the correlation logic 7. The correlation logic 7 comprises circuitry which acts as a set of matched filter for each count of the chord types listed in Table 1. For each count state of the chord counter 4, Table 2 indicates whether or not an output from one the output ports of the correlation shift register is to be used as is, or if it will be inverted. A "1" entry in Table 2 indicates no bit inversion. The 12 data output ports are labelled for convenience as musical notes in Table 2. The first bit shift out of note status register 12 corresponds to the musical note B.

TABLE 2

| Chord | Correlation Shift Register Output | | | | | | | | | | | |
|---|---|---|---|---|---|---|---|---|---|---|---|---|
| Counter State | C | C# | D | D# | E | F | F# | G | G# | A | A# | B |
| 0 | 1 | 0 | 0 | 0 | 1 | 0 | 0 | 1 | 0 | 0 | 0 | 0 |
| 1 | 1 | 0 | 0 | 0 | 1 | 0 | 0 | 1 | 0 | 0 | 0 | 0 |
| 2 | 1 | 0 | 0 | 1 | 0 | 0 | 0 | 1 | 0 | 0 | 0 | 0 |
| 3 | 1 | 0 | 0 | 0 | 1 | 0 | 0 | 1 | 0 | 0 | 1 | 0 |
| 4 | 1 | 0 | 0 | 1 | 0 | 0 | 1 | 0 | 0 | 1 | 0 | 0 |
| 5 | 1 | 0 | 0 | 0 | 1 | 0 | 0 | 0 | 1 | 0 | 0 | 0 |
| 6 | 1 | 0 | 0 | 0 | 1 | 0 | 0 | 1 | 0 | 0 | 0 | 1 |

Figure 5:
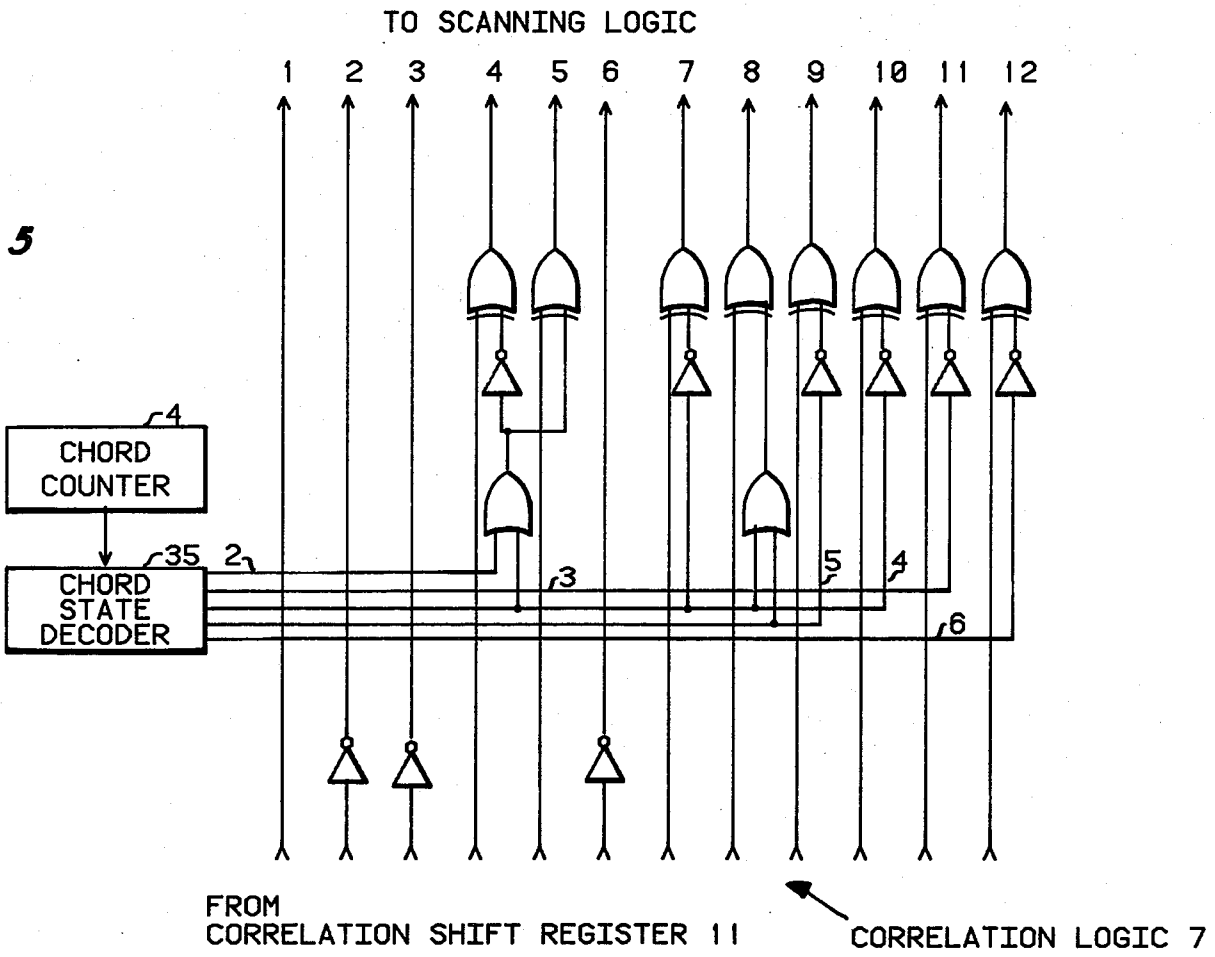
FIG. 5 is a schematic drawing of the correlation logic.

The details of the correlation logic 7 which implements the logic in Table 2 is shown in FIG. 5. Since the output of the first position (note C in Table 2) is always a "1", this transfer can be "hardwired" for all of the chord types. A similar constancy of a "0" exists for output positions 2, 3, and 6. These positions are accomodated for all chord types by using a fixed bit inverter as shown in FIG. 5.

The scanning logic shown in FIG. 4 consists of the combination of the decoder 6, the set of 12 AND gates 23A though 23L, and the OR gate 24.

Each time that the scan counter 2 is reset because of its modulo counting action, a RESET signal is generated which is used to advance the data being read out of the note status register 12. The same RESET signal is also sent to advance the data stored in the correlation shift register 11. Therefore there are 12 clock intervals from the master clock 1 assigned to each programmed state of the logic in the correlation logic 7. For each count state of the scan counter 2, decoder 6 decodes the binary coded state of the scan counter to one of 12 output signal lines. These 12 output signal lines in conjunction with the 12 AND gates 23A to 23L, causes the output data lines from the correlation logic 7 to be sequentially scanned and the scanned data is sent to the OR gate 24.

Each time that an output signal from the correlation logic 7 is scanned by the decoder 6 and one of the set of AND gates 23, is found to be in a "1" state, the OR gate 24 transfers this "1" state to increment the correlation counter 8.

The correlation counter 8 is incremented by signals received from OR gate 24. This counter is implemented to count modulo 12 which is the maximum number of "1" state signals that can be received by scanning the output signals from the correlation logic for any given state of the chord counter 4.

The correlation counter 8 is placed in its initial state by the RESET signal generated each time that the scan counter 2 is reset because of its modulo 12 counting implementation.

In the fashion described previously, the content of the correlation counter at the end of any scan cycle of 12 counts of counter 2, will be the correlation number, or the cross-correlation number, of the input data contained in the note status register 12 and the current associated chord associated with the state of the chord counter 4. Moreover, the root note of the chord associated with this cross-correlation number will be the count state of the shift counter 3. It is customary to call the cross-correlation number by the abbreviated term of "correlation number" when no ambiguity arises of whether the correlation is between two different signals or with one signal and itself.

As described above, when the scan counter 2 resets itself because of its modulo counting implementation, the correlation counter 8 is reset thereby enabling it to start a new correlation count. The comparator 10 is constantly comparing the highest previously detected correlation number value contained in the segment 1 of the chord memory 9 with the current count state of the correlation counter 8. If it is found that the value of the correlation number in the correlation counter 8 is greater than the current maximum value stored in segment 1 of the chord memory 9, the new maximum value is stored in this memory segment.

The output line A from the chord memory 9 corresponds to the stored correlation numbers in segment 1. Since the maximum correlation numbers value is 12, the sgement 1 memory consists of 4 binary bits. The output line A represents a set of 4 lines, although for drawing simplicity only one such line is shown in FIG. 4 to represent the entire set of lines. In the same fashion, the single signal line from the correlation counter 8 to the comparator 10 represents a similar set of 4 signal lines.

The data select gate 25 is one of a set of 4 identical select gates. Each one of these data select gates is associated with one of the 4 lines containing the current count state of the correlation counter 8.

If the comparator 10 finds that the current value in the correlation counter 8 is less than or equal to the current value stored in segment 1 of the chord memory 9, a "0" state signal is placed on line 29 by the comparator 10. In response to "0" signal on line 29 and the signal inversion action of the invertor 28, the data select 25 will cause the data on line A to be rewritten into segment 1 of the chord memory 9.

If the comparator 10 finds that the current value in the correlation counter 8 is greater than the current value stored in segment 1 of the chord memory 9, a "1" state signal is placed on line 29 by the comparator 10. In response to a "1" signal on line 29, the data select 25 will transfer the current state of the correlation counter 8 to be stored in segment 1 of the chord memory 9.

The single output line B shown in FIG. 4 represents a set of 4 lines containing the 4 bits of binary data stored in segment 2 of the chord memory 9. These 4 bits designate one of the 12 notes in the musical octave. Similarly the data select gate 26 represents one of a set of 4 identical select gates corresponding to each of the 4 bits used to designate a note in the musical octave.

If a "0" signal is present on line 29, then the current stored root note number found on line B is transferred by the select gate 26 to be rewritten in segment 2 of the chord memory 9. If a "1" signal is present on line 29, the current state of shift counter 3 is transferred by data select gate 26 to be written in segment 2 of the chord memory 9. This new value corresponds to the root note for a new detected maximum value of the correlation counter 8.

The single output line C from the chord memory 9 represents a set of 3 lines containing the 3 bits of binary data stored in segment 3 of the chord memory 9. These 3 bits designate one of the 7 chord types corresponding to the library of chord types listed in Table 1. Similarly the data select gate 27 represents one of a set of 3 identical select gates corresponding to each of the 3 bits used to designate one of the 7 chord types in the implemented library set of chords.

If a "0" signal is present on line 29, then the current stored chord type found on line C is transferred by the select gate 27 to be rewritten in segment 3 of the chord memory 9. If a "1" signal is present on line 29, the current state of chord counter 4 is transferred by data select gate 27 to be written in segment 3 of the chord memory 9. This new value corresponds to the chord type for a new detected maximum value of the correlation counter 8.

It should be noted that the comparison logic described above provides a desirable detection priority for the chord types. The priority is that listed in Table 1 with a major chord having the highest priority. The listed priorities correspond with the usual frequency of usage of this set of chords in playing popular music. In the preferred embodiment of the present invention, a major chord is given the greatest priority and a major 7'th chord is given the least priority. In the described embodiment of the invention, if two or more chord types yield identical correlation values, the decision is automatically made to select the chord type having the highest priority.

The preferred embodiment also automatically encompasses the situation in which "nonsense" information is presented to the detection system by actuating a set of keyboard switches that does not correspond to any of the implemented library of chord types or, in fact, to any musical chord. For example, the input might consist of 2 to 5 consecutive notes in the musical scale. Even for such "nonsense" data input, the detection system will select a chord type and root note. The selection, as in all other cases, is based upon a "closest" measure to one of the library of chord types. "Closest" is measured as that chord type that produces the largest value of the correlation number and wherein the existence of a plurality of equal values is resolved by the above described chord type priority decision implementation.

At the end of a complete correlation for the library of 7 chord types, the best available chord type and root note decision is available from the set of AND gates 30 and 31. AND gate 31 represents 1 of a set of 3 identical AND gates and AND gate 31 represents 1 of a set of 4 identical AND gates.

The chord type and root note information available at the end of each complete cycle of detection is transferred to the utilization means 32. There are many configurations for the utilization means 32 depending upon the musical effects desired. FIG. 1 shows details of the utilization means 32.

When the keyboard frets are connected in parallel octaves, the fret signal data will cause keyed chords to become inverted if the chord notes are not all played within a single octave. For example, if the major chord consisting of the actuated key notes G#2, C3, D#3 is played, the detection system shown in FIG. 1 and previously described will detect a major chord consisting of the notes C,D#,G# and G# as the root. This inversion will still sound musically correct and no problem is encountered with the G# root note as it is the root of both the original and inverted chord. Chord inversion is not an inherent characteristic of the present invention, but rather is a result of obtaining input note data information from a fingerboard in which the frets are connected in paralled octaves. For example if a A minor seventh chord is keyed with the notes A3, $C_4$, $E_4$, $G_4$, then because of the octave inversion wiring the input data is the chord C, E, G, A. The system shown in FIG. 4 will detect this as a C sixth chord with note C as the root note.

The decisions made by the system shown in FIG. 4 for one to five note chords are summarized in the following list.

One note chord (i) system will select a major chord with the detected not chosen as the root note.

Two note chords (i) minor 2nd: selects major chord with the higher note chosen as the root note.

(ii) major 2nd: selects major chord with the higher note chosen as the root note.

(iii) minor 3rd: selects major chord with the root note a major 3rd below the lower note.

(iv) major 3rd: selects major chord with lower note chosen as root note.

(v) 4th: selects major chord with higher note chosen as root note.

(vi) Two consecutive notes: selects major with higher note chosen as root note.

Three note chords (i) major—selects major chord with lowest note as root.

(ii) minor—selects minor chord with lowest note as root.

(iii) 3-note diminished: selects a dominant 7th chord containing the 3 notes with root note a major third lower than the lowest of the three notes.

(iv) augmented: selects augmented chord with one of original notes as root note.

(v) three consecutive notes: selects a major chord with highest note chosen as root note.

Four note chords (i) dominant 7th—selects dominant seventh (ii) minor 7th, or major 6th—selects a major chord as a major 6th (i.e. if input is C,D#,G,A#, selects D# major chord) with root note that for a major 6th chord.

(iii) diminished 7th—selects diminished seventh with one of original notes as root note.

(iv) major seventh—selects major 7th.

Five note chords (i) 9th chord—selects 7th chord with the same root note.

(ii) major 9th chord—selects major 7th chord with the same root note.

Figure 6:
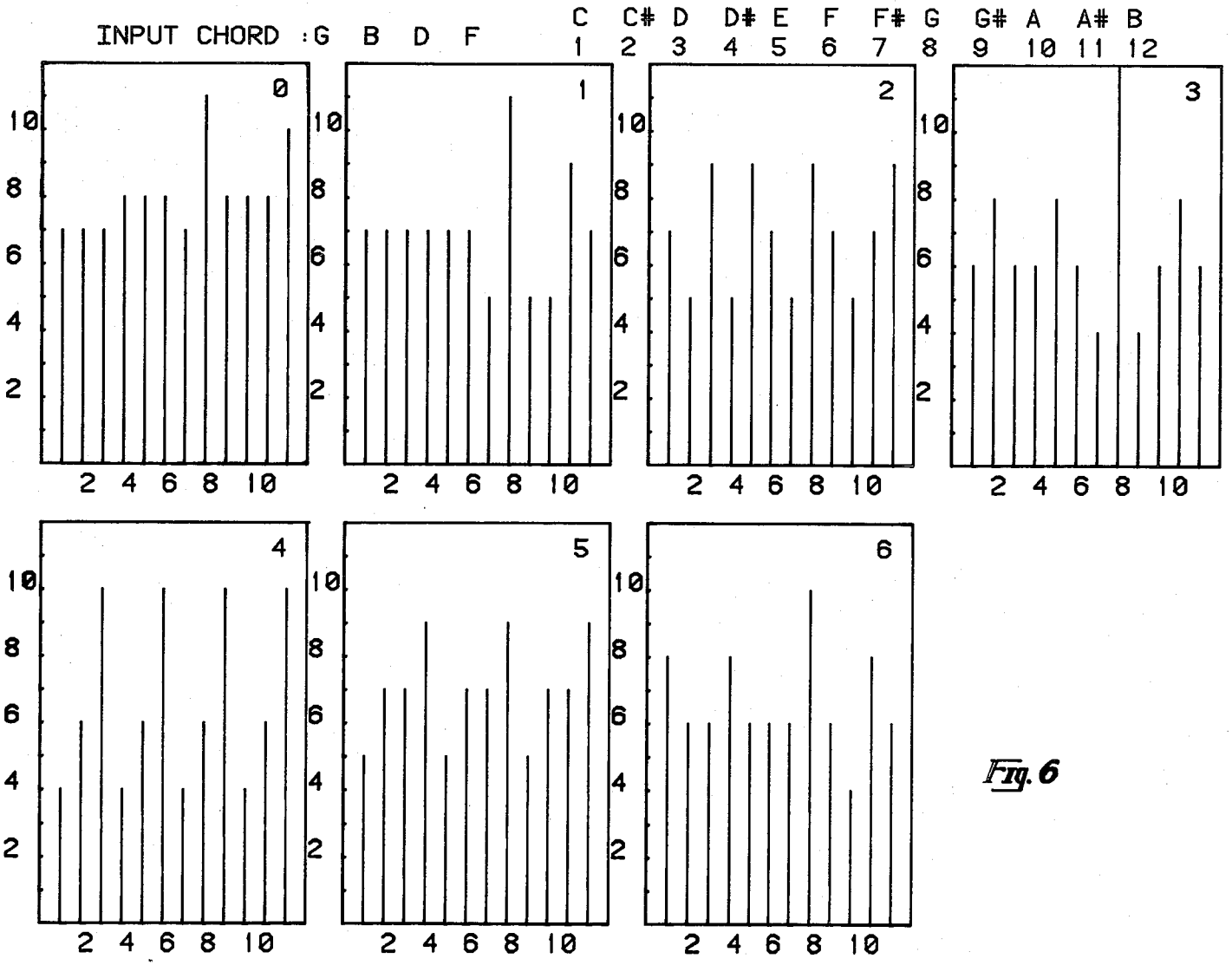
FIG. 6 is a drawing illustrating the chord and root note detection decisions.

FIG. 6 is a diagram which illustrates the operation of the matched filter correlation detection logic of the system shown in FIG. 4. For illustration, the input chord was selected as the sequence of notes G, B, D, F. This sequence spans more than one octave. Because of the folding, or inversion produced by having the frets connected in parallel octaves, the input data is presented to the system as the sequnece of notes D, F, G, B.

The upper right table in FIG. 6 lists the musical note number convention for an octave in which C is the first note number.

Each of the graphs in FIG. 6 corresponds to one of the seven chord types listed in Table 1. The ordinates in the graphs represent the magnitude of the correlation number in the correlation counter at each displacement of data in the correlation shift register 11. The maximum correlation number value occurs for chord type 3 and note number 8. Thus the system selects a dominant 7th chord with G as the root note. This corresponds correctly with the input data.

In the embodiment of the invention as previously described, the detection priority was given to the highest played notes in selecting a root note. This priority was obtained by reading data from the note status register in a sequence starting from the highest to the lowest note in the musical octave. The priority can be reversed by reading data out in a sequence starting from the lowest note. A similar change must be made in the correlation logic in inverting the order of the correlation logic.

The embodiment of the invention shown in FIG. 4 can also be described in the following fashion using signal theory terminology.

The input data from frets connected in parallel octaves are stored in note status register 12. This data is converted into a time domain signal by shifting the data out of note status register to the correlation shift register 11 in response to the reset signals generated by the scan counter 2. The correlation shift register 11 is a device which acts to provide output data corresponding to the input key data in a succession of cyclically permutated data order. That is, if the input data set consists of the 12 states a1, a2, . . . , a2. The first cyclically permutated output will be a2, a3, . . . , a12, a1. The second cyclically permutated output will be a3, a4, . . . , a12, a1, a2; and so on. The cyclically permutated outputs are generated in response to the reset signals from the scan counter 2.

A library of matched filters are contained in the correlation logic 7. These matched filters correspond to musical chords. The matched filters are used as transfer functions to process the data present at the output of the correlation shift register 11. For each of the cyclically permutated states of the data in the correlation shift register, the output data is processed by a selected matched filter, or transfer, function. A matched filter processor, as defined in this specification, is the hardware means necessary to perform matched filter processing, which consists of a bit-by-bit multiplication of each bit of the output data by an associated bit of the matched filter which is also a binary sequence because it is by definition a reversed image of the chords in the form of a binary digit sequence.

The output of the transfer function processing is obtained by summing the individual bit-by-bit multiplication. This sum is called the correlation number. More precisely, it is known as the cross-correlation number of the input data and the matched filter.

The combination of the correlation counter 8, comparator 10, select gate 25, and chord memory 9 act as a selection means to obtain and store the maximum value of the correlation number obtained by processing the input data by all the members of the library of matched filters. Ties in the magnitude of the correlation number are resolved by a priority implemented by the order in which the matched filters are stored and accessed by the chord counter 4.

The comparator 10 acts as a decision means in selecting the chord types and root notes.

The function of the chord generator 105 is to generate chord keying signal data in response to the chord type data transmitted by the AND-gates 30 in a format suitable for utilization by the tone generator 110. While almost any of the organ-type tone generators can be used to implement tone generator 110, the present invention is described using a tone generator of the type disclosed in U.S. Pat. No. 4,085,644 entitled: Polyphonic Tone Synthesizer which is hereby incorporated by reference.

Figure 7:
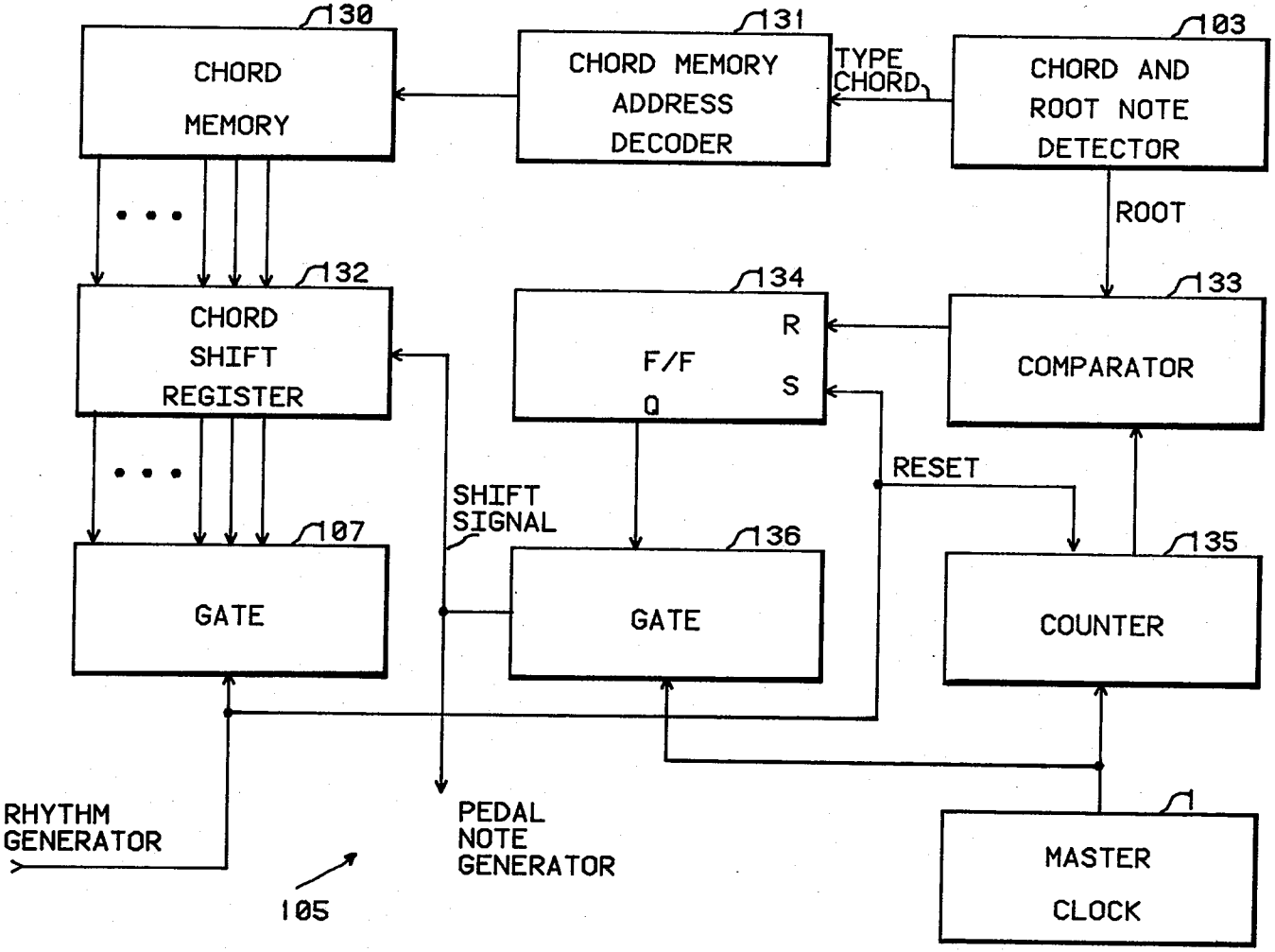
FIG. 7 is a logic diagram of the chord generator.

The detailed logic of the chord generator 105 is shown in FIG. 7. Chord memory 130 is advantageously implemented as a ROM (read only memory) in which is stored the binary data listed in Table 2. Each row of this stored table of values is read out of the 12 output lines of chord memory 130 by the chord memory address decoder 131 in response to the chord type data furnished by the chord and root note detector 103.

An alternative to a ROM for the chord memory 103 would be to implement the equivalent digital logic shown in FIG. 5.

The chord data read out of the chord memory 130 is transposed to correspond to the detected root note by means of the chord shift register 132. The chord shift register can be implemented as a parallel load shift register. The loaded data is shifted in an end-around mode by a number of bit positions equal to one less than root note expressed as a note number in the musical scale. The convention is that the musical note C is given the note number 1 and B is given the note number 12. After shifting, the data residing in the shift register is called the transposed data set.

When a chord actuate signal is received from the rhythm generator, counter 135 is reset to its initial state and the flip-flop 134 is set. When flip-flop 134 is set, a "1" signal is transmitted to the gate 136 which causes this gate to transfer timing signals from the master clock 1 to the shift control for the chord shift register 132. Flip-flop 134 is reset when the comparator 133 detects that the state of the counter 135 is one less than the value of the root note.

Since the master clock 1 is advantageously operated at a 1 Mhz rate, the maximum time for the chord shift operation is 12 microseconds. This time is essentially instantaneous for a musical system.

Figure 8:
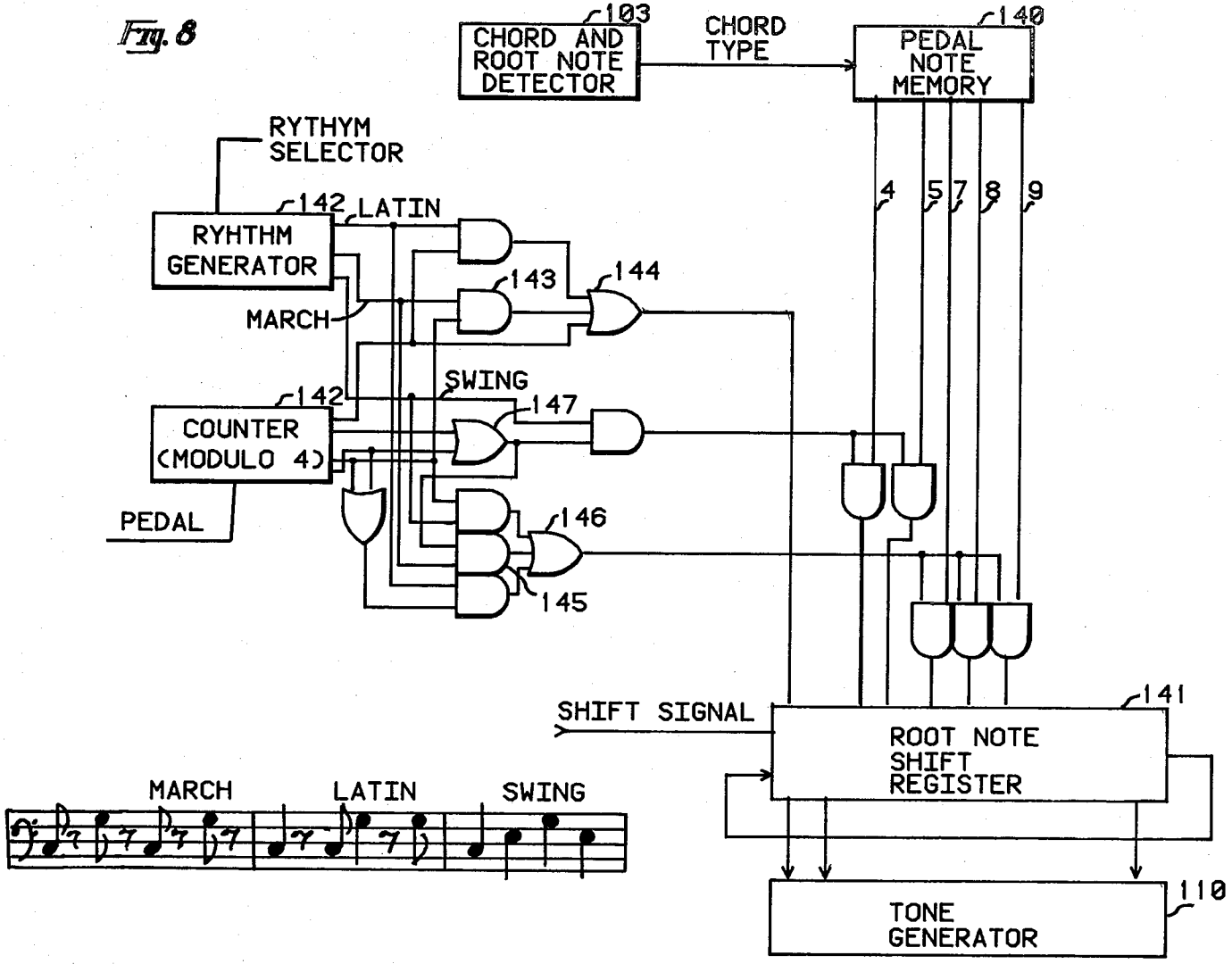
FIG. 8 is a logic diagram of the pedal note generator.

The detailed logic of the pedal note generator is shown in FIG. 8. The pedal note generator must be capable of generating a variety of notes in response to the preselected rhythm pattern and the chord fingered on the guitar.

Pedal note memory 140 is advantageously implemented as a ROM containing the binary data listed in Table 3.

TABLE 3

| | Pedal Note Memory | | | | | | | | | | | |
|---|---|---|---|---|---|---|---|---|---|---|---|---|
| Chord type | C | C# | D | D# | E | F | F# | G | G# | A | A# | B |
| 0 | 1 | 0 | 0 | 0 | 1 | 0 | 0 | 1 | 0 | 0 | 0 | 0 |
| 1 | 1 | 0 | 0 | 0 | 1 | 0 | 0 | 1 | 0 | 0 | 0 | 0 |
| 2 | 1 | 0 | 0 | 1 | 0 | 0 | 0 | 1 | 0 | 0 | 0 | 0 |
| 3 | 1 | 0 | 0 | 0 | 1 | 0 | 0 | 1 | 0 | 0 | 0 | 0 |
| 4 | 1 | 0 | 0 | 1 | 0 | 0 | 1 | 0 | 0 | 0 | 0 | 0 |
| 5 | 1 | 0 | 0 | 0 | 1 | 0 | 0 | 0 | 1 | 0 | 0 | 0 |
| 6 | 1 | 0 | 0 | 0 | 1 | 0 | 0 | 1 | 0 | 0 | 0 | 0 |

An alternative implementation for the pedal note memory 140 is to use digital logic similar to that shown in FIG. 5.

The pedal note generator 106 shown in FIG. 8 is illustrated for three rhythm types. The extension to other rhythm types is immediately obvious as an extension to the following description of the operation.

In response to a preselected actuated switch on the rhythm generator, one of the output lines from the rhythm type selector 142 is activated to a "1" logic state.

The pedal logic signal output from the rhythm generator 104 is used to increment the state of the counter 142. Counter 142 is implemented to count modulo 4.

For illustration, suppose the "march" rhythm has been selected. The four binary states of the counter 142 are decoded to the four timing lines shown in FIG. 8. The output from OR-gate 144 will be a "1" logic state for all the illustrated rhythm types when counter 142 is in its "0", or initial state. It will also be a "1" for a march when counter 142 is in its "2" count state. In response to a "1" state signal from OR-gate 144 a "1" signal is placed in the 1 note number position of the root note shift register 141. When counter 142 is in its count state 2, a "1" signal will appear at the output of OR-gate 144 for the selected march rhythm. In response to a "1" signal from OR-gate 146, AND-gates 147 will cause the binary states on lines 7 and 8 to be loaded into the root note shift register 141. When counter 142 is in either its state 1 or 3, then the output of the OR-gate 142 in conjunction with And-gate 145 produces a "1" state output to the set of And-gates 147.

The pedal data in the root note shift register is shifted in the usual end-around mode in response to the shift signal generated as shown in FIG. 8. The end-around shifting of the data is equivalent to a pedal note transposition means. The output data from the root note shift register 141 is used to operate the pedal tone division of the tone generator 110.

Examination of the logic shown in FIG. 8 will demonstrate that the root note shift register is loaded in the fashion shown in the conventional music notation.

The output from gate 107 in ig. 1 is used to replace the usual keyboard switch data input to the tone generator 110. This data can also be introduced in parallel with the keyboard switches if simultaneous operation of both the keyboard tone generator is desired with the guitar.

A comparison of the entries in Tables 2 and 3 shows that Table 3 is the same as Table 2 except for the entries for note numbers 10, 11, and 12. In Table 3, these note numbers all correspond to the binary bit "0". Therefore, an economy can be easily obtained by using only the chord memory 130 in place of the pedal note memory. Another alternative implementation is to use logic similar to that shown in FIG. 5 for the pedal note memory.

Automatic arpeggio can be inserted into the guitar accompaniment as shown in FIG. 1. Switch S2 is used to actuate the automatic arpeggio generator 109. Almost any of the known varieties of automatic arpeggio generators can be used. For example, a suitable generator is described in U.S. Pat. No. 3,854,366 entitled Automatic Arpeggio.

The generator described in 3,854,366 uses input data from a keyboard which is stored in a note storage register. The present system can be used as the input data source by connecting the output from the chord shift register 132 into the parallel data loading inputs of the note storage register shown in FIG. 1 of the U.S. Pat. No. 3,854,366.

The guitar player can, at his option, stop strumming the strings and simply finger notes and chords. The fingered data is used as previously described to generate accompaniment, or even solo musical tones whether or not the guitar is strummed. Switch S3 is used to disable the tone generator if no accompaniment tones are desired.

The octave select 113 is used to change the musical pitches created by the tone generator 110 to any desired octave. If the tone generator is implemented using the system described in the previously referenced patent 4,085,644 then the octave control can be implemented as a selectable set of frequency dividers inserted between the note clocks and the note shift registers.

We claim:

1. In combination with a fretted musical instrument having a plurality of electrically conducting strings, apparatus for providing automatic accompaniment comprising;

a means for generating fret signals corresponding to members of said plurality of electrically conducting strings pressed into contact with frets on said fretted musical instrument, a string selection means for selecting said fret signals corresponding to a preselected subset of said plurality of electrically conducting strings, a chord detect means responsive to said selected fret signals comprising a matched filter processor wherein a musical chord type is selected from a preselected set of musical chord types irrespectively of whether or not said fret signals comprise a musical chord type, a root note detect means responsive to said selected fret signals for selecting a chord root note corresponding to said selected musical chord type, a note data generator means responsive to said selected musical chord type and said selected chord root note wherein input note data is generated, and a tone generator for creating musical tones at pitches responsive to said input note data.

2. In combination with a fretted musical instrument having a plurality of electrically conducting strings, apparatus for producing automatic accompaniment comprising;

a clock providing timing signals, a string scanning means responsive to said timing signals wherein a string signal is created and is applied sequentially and cyclically to said plurality of electrically conducting strings, a string selection means interposed between said string scanning means and said plurality of electrically conducting strings whereby said string signal is applied to selected strings in said plurality of electrically conducting strings, fret circuitry whereby a fret signal is generated in response to said string signal when said selected strings are pressed into contact with frets on said fretted musical instrument, note decoding means responsive to said fret signals wherein a note number signal is generated, a status memory means for storing said note number signals, a first memory means for storing data to be thereafter read out, a transfer means whereby data is read from said status memory and stored in said first memory means, a second memory means for storing a plurality of transfer functions each corresponding to members of said preselected set of musical chord types, a correlation evaluation means responsive to selected members of said plurality of transfer functions and responsive to data accessed from said first memory wherein a plurality of correlation numbers are generated a third memory means wherein a correlation number is stored to be thereafter read out a comparison means for comparing the magnitude of each of said plurality of correlation numbers with the correlation number stored in said third memory means wherein a correlation number having the maximum value is selected and stored in said third memory means, a selection means responsive to said timing signals and said correlation number having a maximum magnitude value wherein a selection is made of a musical chord type from said preselected set of musical chord types, a root note detect means responsive to said selection of a musical chord type wherein a root note is selected, a note data generator means responsive to said selected musical chord type and said selected root note wherein input note data is generated, and a tone generator for creating musical tones at pitches responsive to said input note data.

3. Apparatus according to claim 2 wherein said root note detect means comprises:

a root note selection means responsive to said timing signals and said correlation number having a maximum magnitude value wherein a selection is made of a root note corresponding to a selection of a musical chord type by said selection means.

4. Apparatus according to claim 3 wherein said clock further comprises:

a master clock for generating a sequence of timing signals, a scan counter incremented by said sequence of timing signals wherein said scan counter counts modulo the number of data words stored in said status memory and wherein a reset signal is created when said scan counter is reset at its maximum count, a shift counter incremented by said reset signals wherein said shift counter counts modulo the number of data words stored in said status memory and wherein a shift reset signal is created when said shift counter is reset at its maximum count, and a chord counter incremented by said reset signals wherein said chord counter counts modulo the number of said plurality of transfer functions and wherein a chord reset signal is created when said chord counter is reset at its maximum count.

5. Apparatus according to claim 4 wherein said transfer means comprises:

coincidence circuitry wherein a start signal is generated in response to a simultaneous creation of said reset signal, said shift reset signal, and said chord reset signal, and memory addressing means responsive to said start signal wherein data is addressed out from said status memory means each time said reset signal is created by said scan counter.

6. Apparatus according to claim 5 wherein said memory addressing means further comprises:

a memory access logic means responsive to the count state of said chord counter whereby data addressed out from said status memory means is stored in said first memory means when said count state attains its minimum value, and memory address decoding means responsive to said reset signals wherein data is accessed from said first memory means in a cyclic permutation order.

7. Apparatus according to claim 6 wherein said correlation evaluation means further comprises;

a function select means responsive to count states of said chord counter whereby a corresponding member of said plurality of transfer functions is selectively read out from said second memory means in response to each count state of said chord counter, a multiplication means wherein data accessed from said first memory means is multiplied by said transfer function read out by said function select means thereby generating a plurality of product values, and an adder means wherein said plurality of product values are summed to generate said correlation numbers in said plurality of correlation numbers.

8. Apparatus according to claim 7 wherein said comparison means further comprises;

a comparison selection means wherein each member of said plurality of correlation numbers generated by said adder means is compared with said correlation number stored in said third memory means and wherein the correlation number having the largest magnitude is selected and stored in said third memory means, and a selection signal generator means wherein a selection signal is generated when said comparison selection means selects said correlation number having the largest magnitude.

9. Apparatus according to claim 8 wherein said selection means further comprises;

a chord type memory means for storing data to be thereafter read out, and a selection memory address means responsive to said selection signal wherein the count state of said chord counter is stored in said chord type memory means.

10. Apparatus according to claim 8 wherein said root note selection means further comprises;

a root type memory means for storing data to be thereafter read out, and a root selection memory address means responsive to said selection signal wherein the count state of said shift counter is stored in said root note memory means.

11. Apparatus according to claim 2 wherein said second memory means further comprises;

an addressable memory storing a plurality of data words corresponding to said plurality of transfer functions wherein each member of said plurality of data words comprises a binary number having bit values forming a matched filter for said corresponding musical chord type.

12. Apparatus according to claim 3 wherein said note decoding means comprises;

note connection circuitry wherein all frets signals corresponding to the same note number are combined to provide said note number signal, a note counter means incremented by said sequence of timing signals wherein said note counter means counts modulo 12, and note gating means responsive to count state of said note counter means wherein said note number signals are provided to said chord detect means and said root note detect means.

13. Apparatus according to claim 3 wherein said note data generator means comprises;

a chord memory means storing a plurality of data sets wherein each member of said plurality of data sets corresponds to a musical chord type, a chord memory select means responsive to said selected chord for accessing a corresponding member of said plurality of data sets from said chord memory means, and chord transposition means responsive to selected chord root note whereby said accessed member of said plurality of data sets from said chord memory means is transposed.

14. Apparatus according to claim 13 wherein said chord transposition means comprises;

a transposition memory means for storing data to be thereafter read out, and transposition addressing means responsive to said chord root note wherein data stored in said transposition memory is cyclically permutated.

15. Apparatus according to claim 13 wherein said note data generator means further comprises;

an automatic rhythm generator, and chord rhythm gating means responsive to said automatic rhythm generator wherein said data accessed from said chord transposition means is gated in a preselected rhythmic pattern to provide said input note data.

16. Apparatus according to claim 3 wherein said note data generator means comprises;

a pedal note memory means storing a plurality of data sets wherein each member of said plurality of data sets corresponds to a musical chord type, a pedal note memory select means responsive to said selected chord for accessing a corresponding member of said plurality of data sets from said pedal note memory means, and pedal note transposition means responsive to said selected chord root note whereby said accessed member of said plurality of data sets from said pedal note memory means is transposed.

17. Apparatus according to claim 16 wherein said pedal note transposition means comprises;

a pedal transposition memory means for storing data to be thereafter read out, and a pedal transposition means responsive to said chord root note wherein data stored in said pedal transposition memory is cyclically permutated.

18. Apparatus according to claim 17 wherein said note data generator means further comprises;

an automatic rhythm generator, and pedal note rhythmic gating means responsive to said automatic rhythm generator wherein data read out from set pedal note memory means is selected and gated in a preselected rhythmic pattern and provided to said pedal note transposition means.

19. A musical instrument having a plurality of tone generators for generating a plurality of tones and having a plurality of electrically conducting strings and frets for selecting musical notes comprising;

a master clock means for generating a sequence of timing signals and a start signal corresponding to an initial timing signal, string scanning means responsive to said sequence of timing signals wherein said plurality of strings are scanned sequentially and cyclically, fret connection circuitry whereby said frets are connected in parallel octaves and wherein fret signals are generated in response to said scanned plurality of strings for fingered frets, string selection means for selecting fret signals corresponding to a preselected subset of strings from said plurality of electrically conducting strings, note decoding means responsive to said fret connection circuitry wherein note number signals are generated corresponding to said fret signals, a status memory for storing the state of said note numbers, a correlation memory means for storing data, a transfer means responsive to said start signal whereby data is transferred from said status memory to said correlation memory means, a transfer function memory means storing a plurality of matched filters each of which corresponds to a preselected musical chord type, a first memory addressing means responsive to said master clock means whereby each of said matched filters is selected consecutively from said transfer function memory means, a matched filter processor means wherein data stored in said correlation memory means is processed by each of said selected matched filters thereby generating a plurality of correlation numbers each of which corresponds to one of said selected matched filters, a decision means responsive to said plurality of correlation numbers wherein a selection is made of the matched filter corresponding to the maximum of said correlation numbers, and a utilization means responsive to said selection of a matched filter by said decision means wherein musical tones are generated.

20. A musical instrument according to claim 19 wherein said decision means further comprises;

priority assignment means wherein said matched filters are assigned priority values, and priority selection means responsive to said assigned priority values whereby if a multiplicity of said correlation numbers have equal values said selection is made of the corresponding matched filter having the largest of said assigned priority values.

21. A musical instrument according to claim 19 wherein said utilization means comprises;

an automatic rhythm generating for providing a sequence of rhythm timing signals, a chord note generator responsive to selection of said decision means whereby chord note signals are generated, a root generator responsive to selection of said decision means whereby a root note signal is generated, a plurality of tone generators wherein musical tones are created in response to said chord note signals and said root note signals, a chord note rhythm gate inserted between said chord note generator and said plurality of tone generators wherein said chord note signals are transferred in response to said sequence of rhythm timing signals, and a pedal note rhythm gate inserted between said root note generator and said plurality of tone generators wherein said root note signal is transferred in response to said sequence of rhythm timing signals.

22. A musical instrument according to claim 21 wherein chord note generator comprises a chord transposition means responsive to said root note signal.

* * * * *